US005481987A

United States Patent [19]

Maitland

[11] Patent Number: 5,481,987

[45] Date of Patent: Jan. 9, 1996

[54] DESK-MOUNTED COMPUTER WORKSTATION MODULES

[76] Inventor: Anthony J. Maitland, 913 Provincetown Dr., Salinas, Calif. 93906

[21] Appl. No.: 265,312

[22] Filed: Jun. 24, 1994

[51] Int. Cl.[6] ..... A47B 13/08

[52] U.S. Cl. ..... 108/90; 312/196

[58] Field of Search ..... 108/6, 90, 96; 312/196

[56] References Cited

U.S. PATENT DOCUMENTS 4,561,619 12/1985 Robillard .
4,781,126 11/1988 Lochridge .
5,076,905 12/1991 Hyatt .
5,120,117 6/1992 Williams .

*Primary Examiner*—Peter M. Cuomo
*Assistant Examiner*—Gerald A. Anderson

[57] ABSTRACT

Desk-mounted computer workstation modules are disclosed consisting of 1) a computer monitor support structure that affixes to an existing desk or other floor-supported platform, and 2) an extended work surface that partially surrounds the support structure at the rear and the user at the front of the surface. The support structure module extends beyond the back of the platform to which it is affixed, while providing variable tilt and functional stability for the work surface module through height-adjusting linkage. The work surface provides maximum unbroken work area for users while also providing continuous arm support that reduces user fatigue and injury.

1 Claim, 4 Drawing Sheets

DESK-MOUNTED COMPUTER WORKSTATION MODULES

BACKGROUND OF THE INVENTION

Office desks have not yet evolved to accommodate the addition of computer equipment to the modern office suite. Computer monitors and keyboards have been placed on traditional desks, where they occupy an inordinate amount of space. The typical desk is 30" deep, while the monitor and keyboard are 17" and 8", respectively. On that desk the monitor screen will be located only 13" from the user's eyes and there will be only 5" of room left for documents. To move the screen so that it is the recommended 24" away from the user's eyes would require huge desks that are at least 47" deep.

The traditional desk is also deficient in providing adequate support to the desk user because the desk is flat. A flat surface in front of the user presents an edge as a resting place for the hands and arms. For some reason drafting boards have always been large and tilted, but desks are smaller and flat.

Prior art has attempted to address certain of the desk user's computer problems, but success has been limited. Robillard, U.S. Pat. No. 4,561,619, Dec. 1985, discloses a wrap-around, non-tilt work surface with moveable monitor carrier. This single-purpose, multi-media workstation is not for general office use, however.

Lochridge, U.S. Pat. No. 4,781,126, Nov. 1988, presents a desk-mounted workspace that contains a tiltable, wrap-around workstation that remains within the dimensions of the existing desk. A computer monitor can be accommodated but it is too close to the user and placed too high in the field of view.

Williams, U.S. Pat. No. 5,120,117, Jun. 1992, teaches the dangers of carpal tunnel syndrome among computer users. His invention supports the user's hands and lowers the monitor to below the position of the keyboard. This makes the computer support platform a single-use device—unsuitable for other office activities. Because it lack a wrap-around feature, Williams only offers support for the user's arms through wrist rests.

Hyatt, U.S. Pat. No. 5,072,905, Dec. 1991, discloses an add-on wrap-around user-support device for existing desks. This addresses the arm support issue without addressing the monitor positioning problem.

The present invention addresses the problems of computer monitors that are too close and too low, and desks that are too small, too flat, and unsupportive of users. A computer monitor support module moves the monitor away from the user and raises it to an ergonomically-sound position. A work surface module raises the work materials toward the user's eyes, relieving pressure on the neck. The wrap-around portion of the surface supports the user's hands and arms to prevent overuse of shoulder and arm muscles and tendons.

SUMMARY OF THE INVENTION

The principle objects of the present invention were to provide height-adjustable support for a computer monitor at a suitable distance from the user and an expanded, single-level, unbroken work area. An additional object was to make the work surface tiltable so that the work material would be more accessible, thereby requiring less postural deviation from the user. It was also intended that the modules for accomplishing those goals be suitable for retrofitting existing desks, while at the same time being suitable for other platforms or pedestals. These and other objects have been attained in the present invention through the use of a computer monitor support structure and a wrap-around work surface. The support structure is basically a four-sided cube. The bottom, horizontal side of the cube rests on an existing desk and is affixed by mechanical means (clamps or bolts) in such a way that part of the cube extends beyond the back edge of the desk itself. The vertical sides of the cube form the support for the computer monitor's height-adjustable shelf on the inside, and support for the work surface module on the outside. The vertical back of the cube is a solid structural member, while the top and front of the cube are open to allow for viewing and heat dissipation of the computer monitor. Height adjustment of the monitor shelf is accomplished by the independent shelf being seated on common shelf pegs fitted into holes appropriately drilled into the inner sides of the support structure. Other methods of supporting the shelf are available and could be equally effective.

The work surface module is a large, flat substitute for the existing desk top. Its width is similar to the original desk but its depth is greater. At the rear of the work surface is a cut-out portion that allows it to fit closely around the monitor support module that is affixed to the desk. At the front of the work surface is another cut-out portion that allows it to fit around the user, who would be seated at the desk. The rear portion of the work surface can be manually raised and attached to the monitor support structure. Because the front portion of the work surface module remains resting on the leading edge of the desk, tilt is thereby imparted to the work surface. Attachment to the support module is by means of slide bolts attached to the top side of the work surface and inserted into holes appropriately drilled into the support module's outer sides. Degree of tilt is determined by the height above desk level of the support holes engaged by the slide bolts. Other methods of attachment can be equally effective in stabilizing the rear portion of the work surface at various heights above desk level.

By creating an unbroken work surface that extends around the monitor support at the rear and around the user at the front, and allowing various degrees of tilt to the surface, the present invention allows the worker full use of an extended and raised work area without requiring long reaches across empty space.

While currently installed versions of this workstation have been made of wood, other materials suitable for an office environment may be used. It would also be possible to use the support structure to raise and distance the computer monitor without using the tilting work surface, if that was desired. Use of the work surface without the support structure would be possible if another means of tilting and supporting the surface were provided.

DETAILED DESCRIPTION OF THE DRAWINGS

Figure 1:
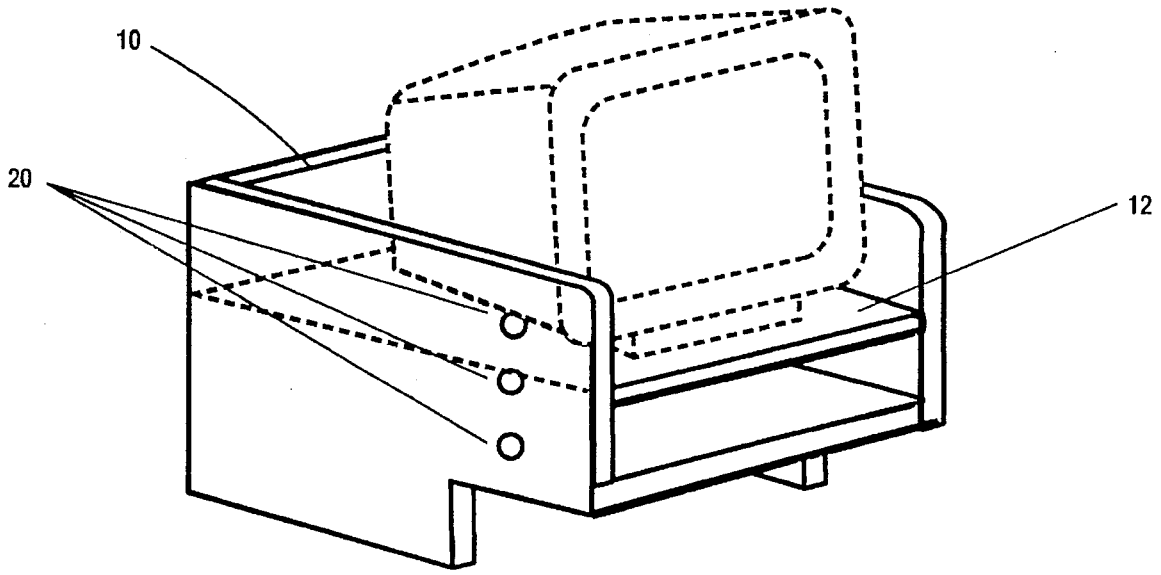
FIG. 1 is a perspective view of the computer monitor support structure alone. A generic computer monitor is indicated but it is not part of the present invention.
Figure 3:
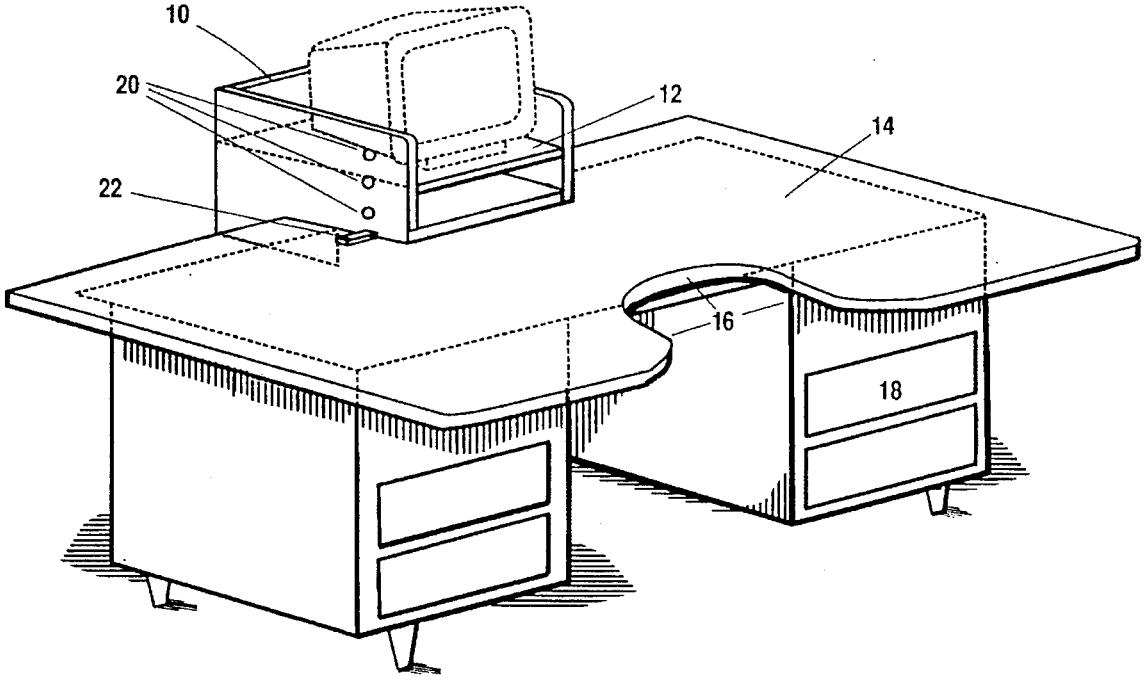
FIG. 3 is a perspective view of both modules shown installed on an existing desk. It illustrates how the work surface module wraps around the computer monitor support module at the rear and wraps around the user at the front. In this illustration the work surface module is not tilted.
Figure 4:
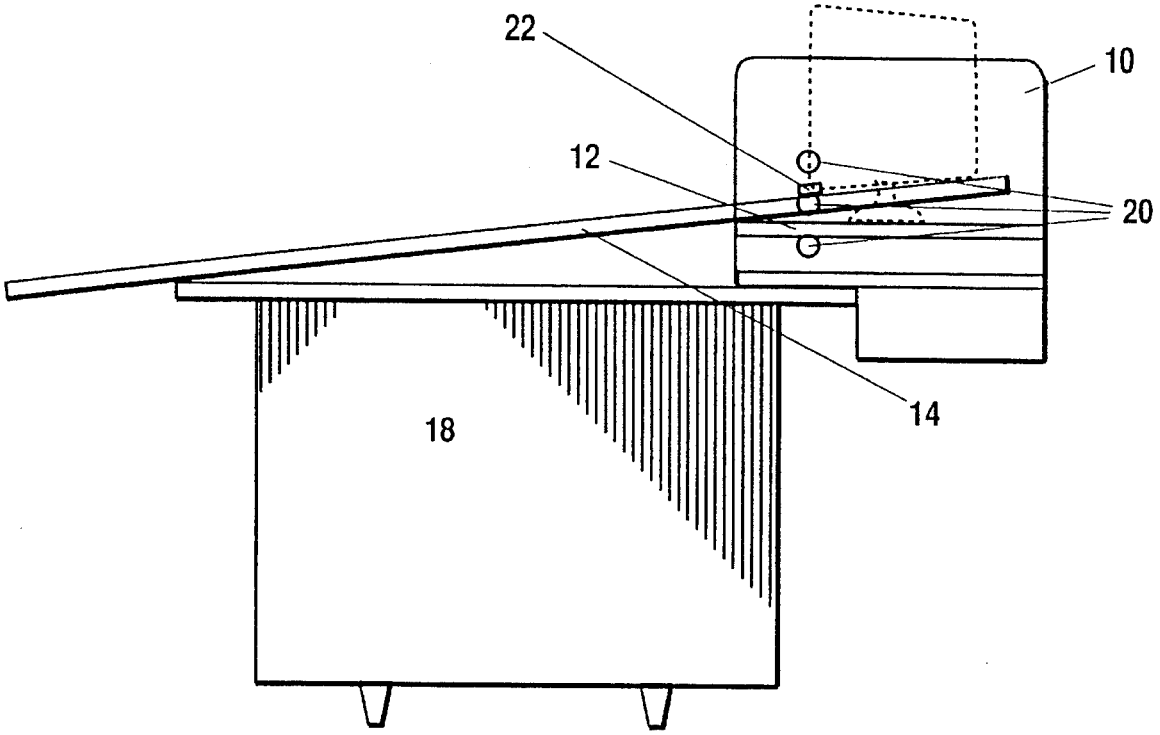
FIG. 4 is a side view of both modules installed on an existing desk. It illustrates the cantilevering of the monitor support structure at the rear of the desk and the extension of the work surface beyond the front edge of the existing desk. In this illustration the work surface is partially tilted.

Referring to FIGS. 1, 3 and 4, numeral 10 indicates the computer monitor support module and numeral 12 indicates the height-adjustable monitor support shelf inside the module. Outside the support module, numeral 20 indicates the height adjustable means of supporting the work surface module.

Figure 2:
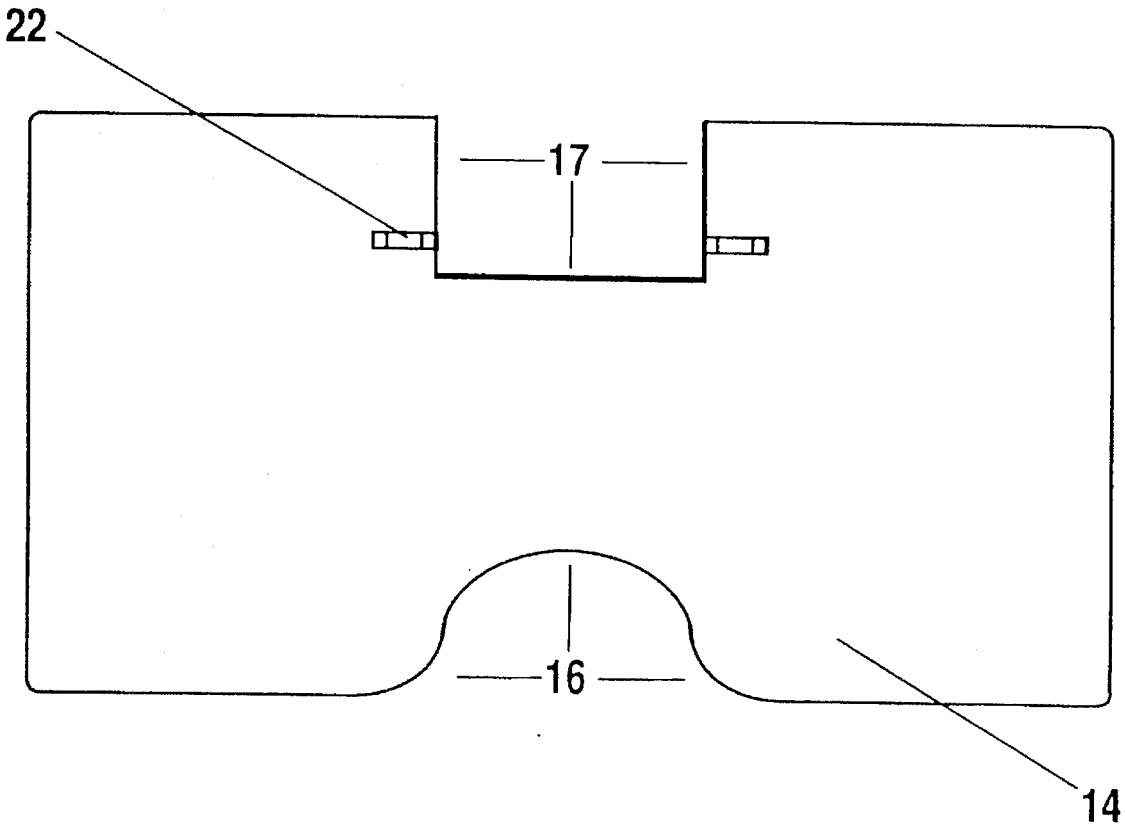
FIG. 2 is an overhead view of the work surface module alone.

In FIGS. 2, 3 and 4, numeral 14 indicates the work surface module, numeral 16 indicates the partially surrounded user station at the front of the work surface module and numeral 17 indicates the partially surrounded space for the monitor support module. Numeral 22 indicates a means of attaching the work surface module to the support structure.

In FIGS. 3 and 4, numeral 18 indicates the existing desk, pedestal, or platform on which the modules are mounted for use.

I claim:

1. A work station for mounting on a desk comprising a support module having a base mounted on a horizontal surface, vertical side walls extending at least upwardly from said base, a shelf mounted between side walls for supporting a computer monitor and a adjustable work surface mounted on said horizontal surface for extending said horizontal surface, said work surface having a cutout on one side extending at least partially around said module side walls such that said module and said work surface fit together, means for adjustable engagement between the work surface and said module side walls such that the angle of the work surface relative to the support surface is variable.

* * * * *